US007874131B2

(12) United States Patent
Morin

(10) Patent No.: US 7,874,131 B2
(45) Date of Patent: Jan. 25, 2011

(54) THREE-DIMENSIONAL, SHOCK-ABSORBING, ERGONOMIC, ANTI-BLOCKING RIDINGS STIRRUP THAT CAN BE ADAPTED TO THE WEIGHT OF THE RIDER AND COMPRISES A FOOT ASSISTING MECHANISM

(76) Inventor: Guy Morin, 13 rue Louvois, Valence (FR) F-26000

( * ) Notice: Subject to any disclaimer, the term of this patent is extended or adjusted under 35 U.S.C. 154(b) by 455 days.

(21) Appl. No.: 11/814,470

(22) PCT Filed: Jan. 10, 2006

(86) PCT No.: PCT/FR2006/000083

§ 371 (c)(1),
(2), (4) Date: Jul. 20, 2007

(87) PCT Pub. No.: WO2006/077307

PCT Pub. Date: Jul. 27, 2006

(65) Prior Publication Data

US 2008/0104934 A1 May 8, 2008

(30) Foreign Application Priority Data

Jan. 24, 2005 (FR) ..... 05 00691

(51) Int. Cl.
*B68C 3/00* (2006.01)

(52) U.S. Cl. ..... 54/47; 54/48

(58) Field of Classification Search ..... 54/47, 54/49, 49.5, 48

See application file for complete search history.

(56) References Cited

U.S. PATENT DOCUMENTS

| | | | | | |
|---|---|---|---|---|---|
| 30,369 | A | * | 10/1860 | Williamson | 54/49 |
| 143,732 | A | * | 10/1873 | Thompson | 54/49 |
| 215,942 | A | * | 5/1879 | de La Nux | 54/49 |
| 403,945 | A | * | 5/1889 | Leinard et al. | 54/49 |
| 459,291 | A | * | 9/1891 | Johnson et al. | 54/49 |
| 722,877 | A | * | 3/1903 | Nikolaisen | 54/49 |
| 807,793 | A | * | 12/1905 | Thompson | 54/47 |
| 1,074,481 | A | * | 9/1913 | Ward | 54/49 |
| 1,160,082 | A | * | 11/1915 | Jarvis | 54/47 |
| 4,587,798 | A | * | 5/1986 | Taylor | 54/49 |
| 6,334,291 | B1 | | 1/2002 | Lelievre | |
| 2005/0229552 | A1 | * | 10/2005 | Dubourg | 54/49 |

FOREIGN PATENT DOCUMENTS

| | | |
|---|---|---|
| DE | 94 570 | 9/1996 |
| DE | 100 43 878 | 4/2002 |

OTHER PUBLICATIONS

International Search Report.

The Written Opinion of the International Searching Authority, a partial English-language translation of the Written Opinion of the International Searching Authority.

* cited by examiner

*Primary Examiner*—Son T. Nguyen
(74) *Attorney, Agent, or Firm*—Greenblum & Bernstein, P.L.C.

(57) ABSTRACT

A riding stirrup includes a supporting structure terminating in a solid shape and a mechanical assembly pivotably mounted on the supporting structure and around the solid shape. Additionally, the riding stirrup includes a floor assembly including at least one U-shaped profile, a floor, and one or more resilient structures, wherein the floor assembly is mounted on the mechanical assembly for vertical movement relative to an axis of the solid shape.

22 Claims, 7 Drawing Sheets

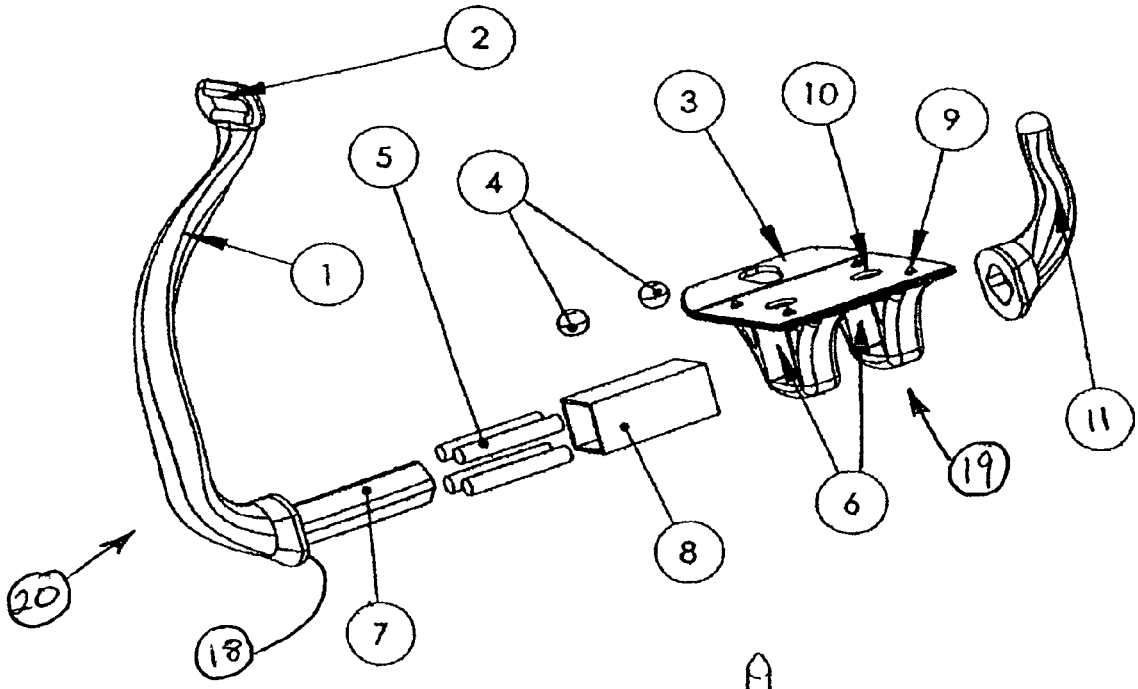
Fig:3
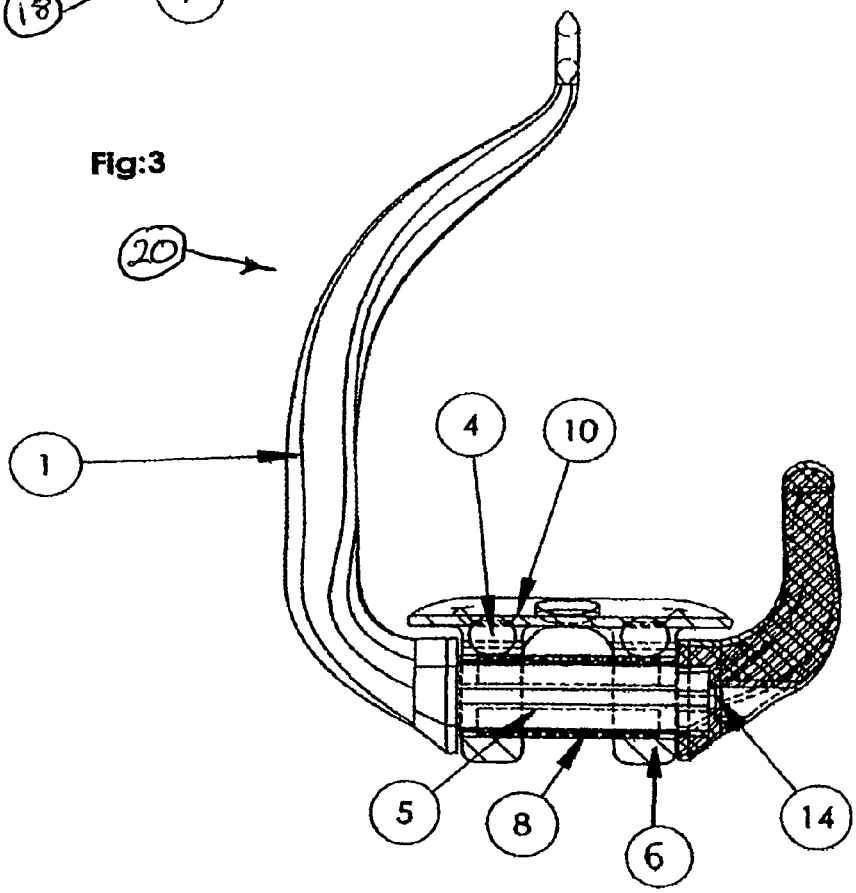

THREE-DIMENSIONAL, SHOCK-ABSORBING, ERGONOMIC, ANTI-BLOCKING RIDINGS STIRRUP THAT CAN BE ADAPTED TO THE WEIGHT OF THE RIDER AND COMPRISES A FOOT ASSISTING MECHANISM

CROSS-REFERENCE TO RELATED APPLICATIONS

The present application is a U.S. National Stage Application of International Application No. PCT/FR2006/000083 filed Jan. 10, 2006, which published as WO 2006/077307 A2 on Jul. 27, 2007 and claims priority under 35 U.S.C. §119 and §365 of French Application No. FR 0500691 filed Jan. 24, 2005.

BACKGROUND OF THE INVENTION

1. Field of the Invention

The present invention relates to a riding stirrup, aimed at providing the rider, at the various speeds, with stability, comfort and security. According to the invention, the various mechanical components used are very precisely calculated with reference to the opposing forces. The value of this innovation includes the reduction of the muscular fatigue and the microtraumatisms generated by the impacts, and the increase in security due to an open three-quarter supporting structure making it easy to remove the foot. Additionally, according to the invention, an ergonomic floor closely hugs the shape of the foot.

2. Description of Background Information

Ninety percent of the stirrups sold are not furnished with a shock-absorbing system. In certain cases the sole on which the foot rests may be furnished with a rubber sole serving more as a non-slip element than a shock absorber. At certain rapid speeds (e.g., full gallop), in the kick-backs, the feet of the rider tend to jump on the sole causing a loss of balance, or loss of the stirrup. The comfort and stability of the rider remain quite precarious, as the impacts imposed by his mount are directly transmitted to the bones, to the muscles and to the ligaments of the rider.

The remaining ten percent of stirrups sold are articulated stirrups furnished with a shock absorber, using either springs or rubber silent blocks. However, the drawback of these existing models are their excess flexibility. The materials used are not sufficiently suitable for the opposing forces, which has the effect of increasing the movements of the foot instead of assisting them. Consequently, many riders have tested and then abandoned them, as the technique does not correspond to the needs of the rider.

SUMMARY OF THE INVENTION

According to the invention, two mechanical components are nested (or intimately connected) in order to form a device or an integral system having five functions (or different independent movements). The supporting structure of the mechanism is manufactured in a single piece cast as a monoblock in a hard metal. The supporting structure terminates in a metal square (or, for example, any other geometric shape of the cruciform type). The top ridge and bottom ridge of the metal square are oriented parallel to the axis of the supporting structure. A metal tube of appropriate length is housed around the metal square. Sections of flexible, elastic materials resistant to compression, such as polyurethane, rubber, silicone or any other materials, are inserted between the four faces of the metal square and the internal corners of the metal tube, to form a mini torsion bar mechanical assembly. Moreover, the flexible, elastic materials include a profile that is round, triangular, round with a shoulder or cast, and are of a suitable length, diameter and hardness. The mini torsion bar is covered with a shock-absorbing mechanism forming a body with an ergonomic floor (on which the foot of the rider rests). The mini torsion bar serves to limit, regulate, meter and above all assist the movements of the foot in its forward and rearward pressures. Moreover, the mini torsion bar limits and assists the balancing movements while regulating them and the mini torsion bar re-establishes the balance and stability forward and rearward, due to the torque ratio returning the floor or the foot to the initial or horizontal position. Furthermore, the flexibility is finely calculated to allow the rider to lower or orient his heel in the position that he desires. Consequently, the muscles, the bones, and the tendons are less stressed due to a more naturally horizontal or flatter position of the foot.

The mini torsion bar is covered or trapped by a metal floor assembly forming the floor. The floor assembly includes profiled supports having an inner side approximately 10 mm greater (in its height) than the tube forming the mini torsion bar. The floor assembly, furnished with the floor is freely adjustable, such that the floor assembly can slide downward or upward on the sides of the tube forming the mini torsion bar.

Two or more spheres of flexible materials are housed between the underside of the floor and the top of the tube of said torsion bar. Additionally, two or more holes (or reservations) are provided in the floor in order to receive these spheres therein. The invention contemplates that spheres, squares, rectangles or any other shapes of polyurethane, rubber, silicone or any other flexible material, or where necessary, springs may be used. According to the invention, the vertical pressure of the foot of the rider compresses and relaxes the spheres trapped between the underside of the floor and the top of the tube. It is easy to understand the comfort provided to the rider by the elasticity of the compressed spheres just under his foot. According to the invention, the spheres are at a distance from one another and they work independently like two shock absorbers, wherein the floor adapts to the various lateral stands of the foot of the rider.

The floor of the stirrup works in three assisted dimensions with return to point zero on the horizontal. In response to vertical pressure of the foot forward or rearward, the torsion bar causes a return to the initial position point zero. Additionally, in response to vertical pressure, flexibility is assisted by the spheres being compressed beneath the floor.

Additionally, vertical, lateral pressure may be assisted by spheres at a distance (hence independent). According to an aspect of the invention, spheres, (or any other shape of materials) of differing hardness and, in embodiments, of various colors may be used and adapted to the weight of each rider. For example, the spheres (or any other shape of materials) may be in brackets of 15 kilos, in order to adapt flexibility to the weight of each rider.

According to a further aspect of the invention, an abutment made of flexible material comes to finalize and close the stirrup at three quarters of its opening and hold the floor assembly. The abutment is attached by a fastening system at the end of the square of the support structure. The abutment may be of different height and/or width, and it may, where necessary, be adjusted to reduce or increase the space reserved for the boot of a rider. Therefore, the stirrup can be adapted to the width of the foot of a rider. Additionally, the abutment may, where necessary, have a shape that is much more closed and has a higher return on the shoe of the rider in order to make it a contact stirrup (in order to prevent losing the stirrup). The purpose of this half-branch or lateral abutment is to keep the foot of the rider laterally in place on the floor (or in the stirrup); the half-branch or lateral abutment is high enough for the foot not to pass over it.

The materials used for the half-branch or lateral abutment are semi-hard (in order to avoid injuring the rider and his mount in the event of a fall) polyurethane, rubber, silicone or any other material. Additionally, the half-branch or lateral abutment may, where necessary, be made of metal covered with flexible material. Furthermore, the half-branch or lateral abutment may, where necessary, pivot to the horizontal on its fastening in the case of a rider fall or in the case of an impact.

The stirrup thus furnished with this half-branch or lateral abutment forms a three-quarter-closed stirrup.

It is easy to understand the whole value of this shape (three-quarter-closed) for the safety of the rider in the event of a fall. The shape of the structure is progressively very open in its height in order to slide the feet therein, and includes an opening of one quarter for removing the foot and a flexible part (or lateral abutment) which twists or pivots to release the foot.

The ergonomic floor is curved and it is adjusted to the shape of the rider's foot. The floor surface and length are judiciously calculated so as not to hamper the rider, while providing maximum stability. Additionally, the floor surface and length are sufficiently great to set in action the mechanism of the mini torsion bar. According to the invention, the floor works like a lever arm on the mini torsion bar mechanism in action. Additionally, a non-slip element is created by a multitude of holes whose circumference is pushed out in protrusions toward the top surface of the floor, or by excrescences of metal. Furthermore, a space may be provided on one of the sides of the floor in order to laterally attach the half-branch or lateral abutment thereto.

The loop retaining the stirrup leather is oriented parallel to the mount of the rider, in order to position the opening of the stirrup facing the tip of the toe of the rider.

BRIEF DESCRIPTION OF THE DRAWINGS

An exemplary nonlimiting embodiment of the invention will be better understood with the following description and accompanying drawings, in which:

FIG. 3 represents an exploded view and an assembled view of the stirrup assembly;

DETAILED DESCRIPTION OF THE INVENTION

Figure 1:
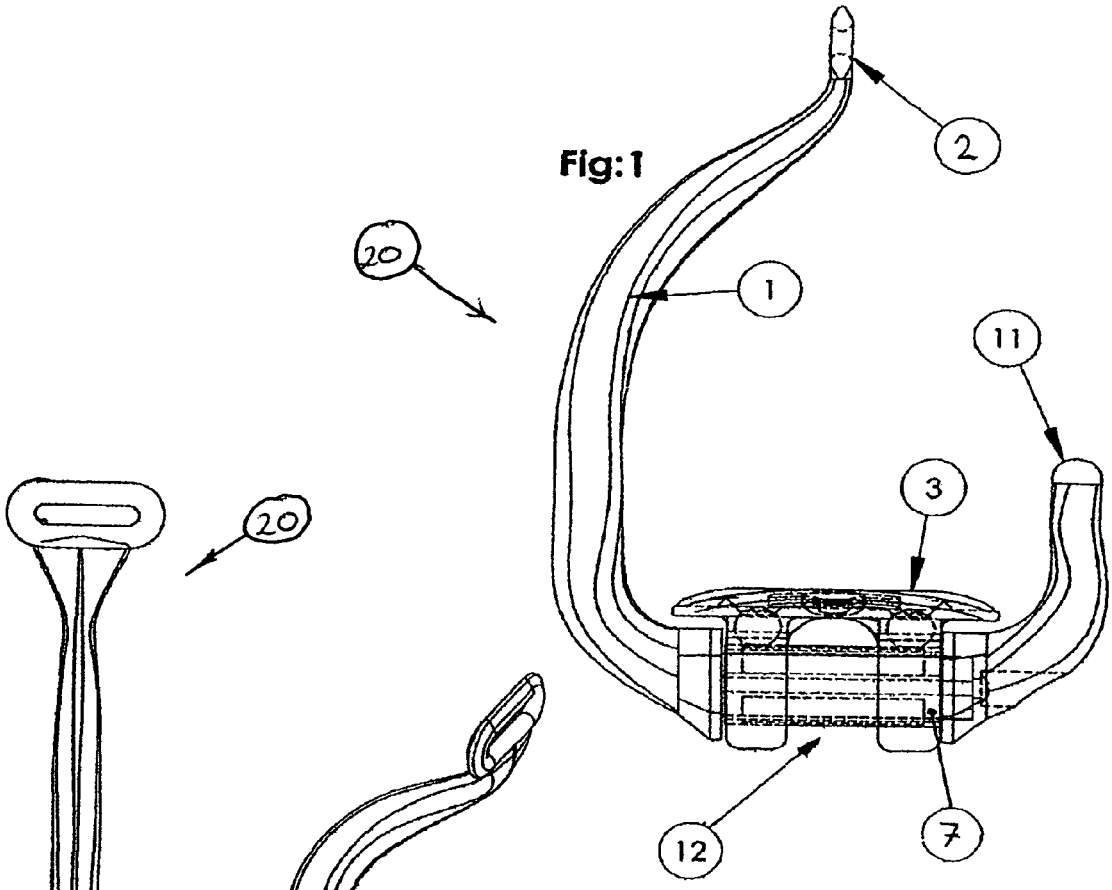
FIG. 1 represents a front view of the integrated supporting structure of the mechanism, and finalized by the foot abutment made of flexible material.

As shown in FIG. 1, the stirrup assembly 20 is formed of a supporting structure 1 on which a mechanical assembly 12 (or mini torsion bar) rests terminating in a foot abutment 11 made of flexible material. The mechanical assembly 12 has the ability by the floor 3 to be lowered from zero to fifty degrees maximum (in relation to the opposing forces) forward or rearward of relative to the vertical of the supporting structure 1. Additionally, the mechanical assembly 12, in response to vertical pressure on the floor 3, falls and rises. Additionally, the pressure on the floor 3 can fall independently on either the side of the floor 3, e.g., on the side of the floor 3 having the supporting structure 1 or on the abutment side 11 of the floor 3.

Detail in the embodiment can be seen in FIGS. 1, 2, 3 and 4.

Figure 2:
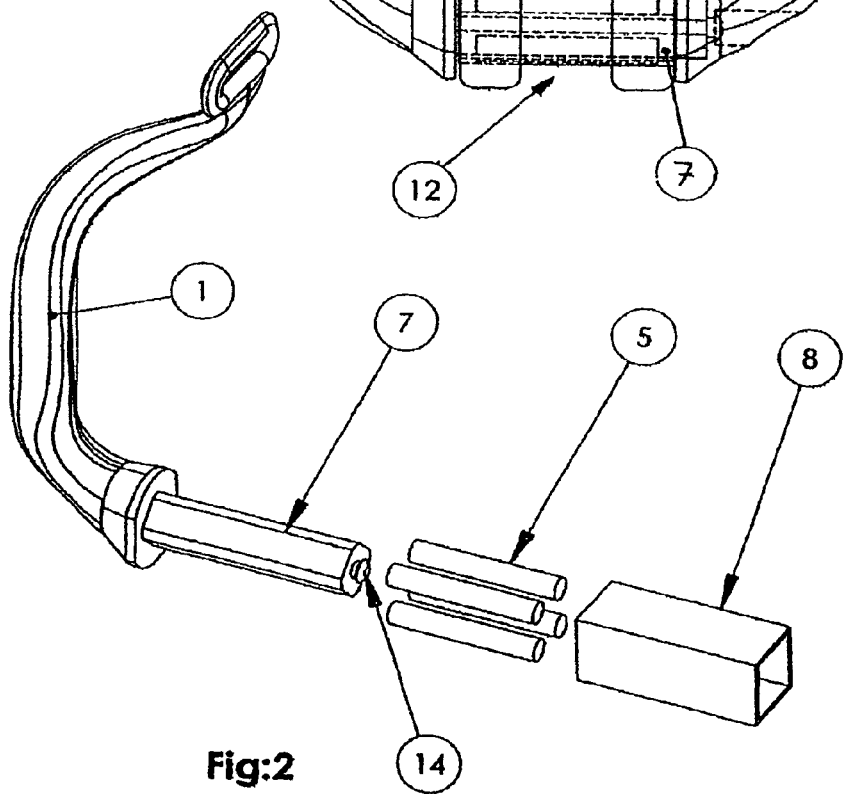
FIG. 2 represents a front view and a side view of said mini torsion bar mechanical assembly.

As shown in FIG. 2, the supporting structure 1 in its shape terminates in a solid square 7. The square 7 (or any other geometric form, for example, an octagon, a diamond, or a cruciform) has several functions. The square 7 serves as a bearing surface to the mechanical assembly 12, on which the torsion movement is created. At an end of the square 7, a fastening 14 is arranged by a part cast from the square 7 having at least two ridges positioned in the vertical direction of the supporting structure 1. As shown in FIG. 2, a section of tube 8 with an inner side greater than the four ridges of the square 7 comes to be housed around the square 7 in order to trap it. The tube 8 will generate the torsion (or pivot) movement forward and rearward. Portions of flexible materials 5 of suitable length and diameter, and of appropriate hardness, such as polyurethane, rubber, silicon or other materials, will penetrate by force between the four faces of the square 7 and the internal corners of the tube 8 in order to materialize the torsion movements of the tube 8. In embodiments, the flexible materials 5 may be round shapes, round shapes with shoulder or triangular shapes.

The floor 3 and its profiled supports 6 together are used to generate the torsion movements of the mechanical assembly 12 of the square 7, the flexible materials 5 and the tube 8.

As shown in FIG. 3, a metal floor assembly 19 is formed of the floor 3 and two U-shaped profiled supports 6 of adjusted dimension, and of an internal height that is approximately ten mm greater than the tube 8. Moreover, the floor assembly 19 formed of the floor 3 and profiled supports 6 forms a single cast part, wherein the floor assembly 19 covers or traps the tube 8.

According to an aspect of the invention, the floor assembly 19 of the floor 3 and the profiled supports 6 supports three different mechanical functions.

The floor assembly 19 is adjusted in contact with the two faces of the tube 8 and can navigate upward. Additionally, the floor assembly 19 is guided and held laterally on one of the sides by the abutment 11 furnished with a shim and on the other side by a shoulder 18 cast in the supporting structure 1.

Figure 4:
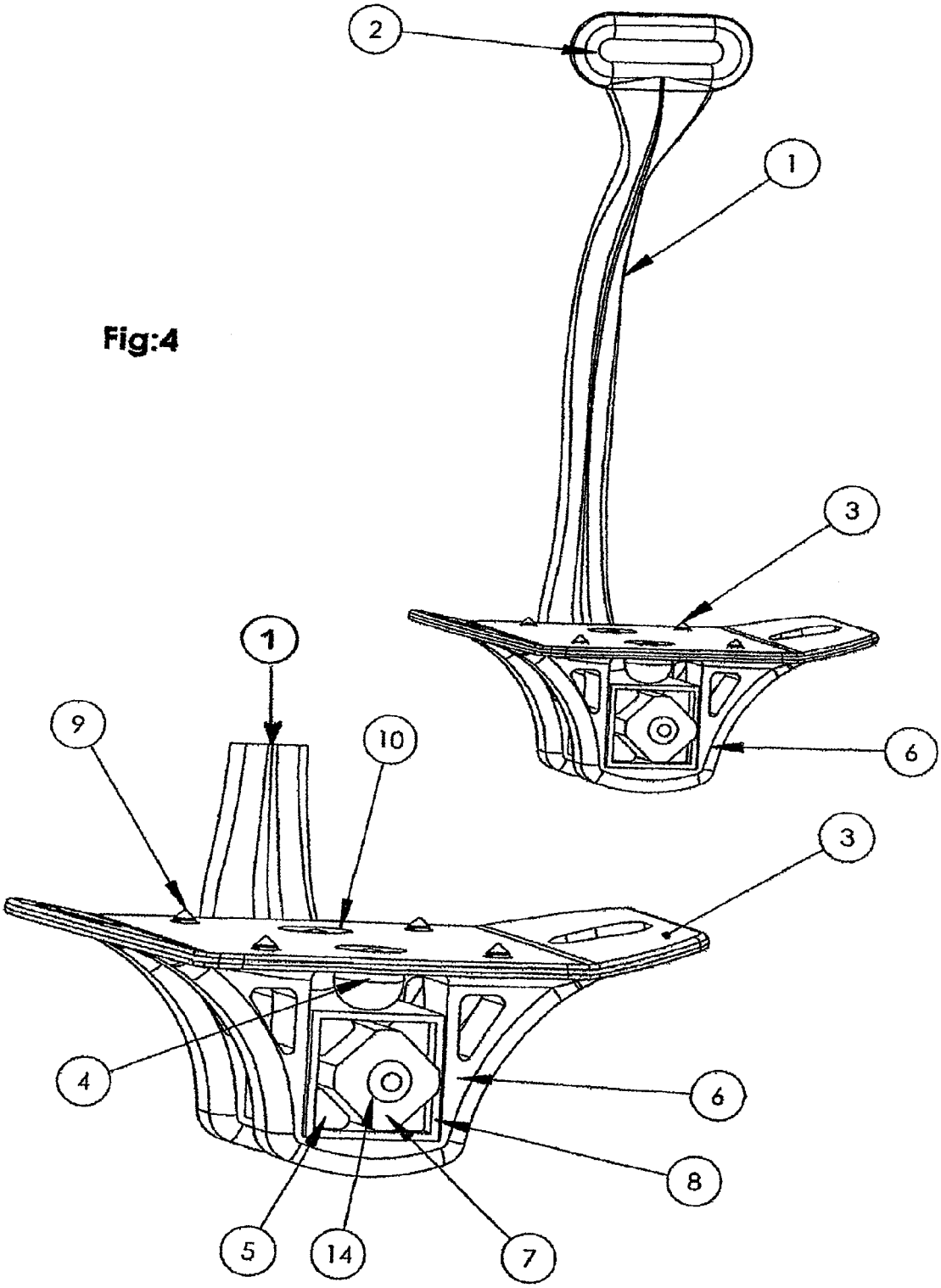
FIG. 4 represents a view of the mechanical assembly and the floor assembly assembled onto the supporting structure.

According to an aspect of the invention, as shown in FIG. 4, two or more spheres 4, squares, or rectangles with a hardness and size (volume) that is appropriate and composed of flexible material, such as polyurethane or other materials, or metal springs, are housed between the floor 3 and the supporting tube 8. Spaces or reservations 10 are machined or arranged in the floor 3 in order to keep the spheres 4 in place at a determined distance.

As shown in FIG. 4, the stirrup assembly 20 generates, by the foot of the rider resting on the floor 3, five different functions while assisting the rider's foot flexibly.

With a first function, vertical pressure force on the front of the floor assembly 19, the floor assembly 19 tilts and takes with it the tube 8 which squeezes the flexible materials 5 on the fixed square 7. Upon a releasing of the pressure force, the floor 3 returns to the horizontal (or point zero).

With a second function, the vertical pressure force on the rear of the floor assembly 19 causes the same effects of return to the horizontal (or point zero). According to an, aspect of the invention, the elastic forces are calculated so that the floor 3 does not adopt an angle greater than twenty degrees.

With a third function, the vertical pressure force on the floor assembly 19 compresses and relaxes the spheres 4 resting on the tube 8 creating a back-and-forth movement. It is easy to understand the whole value of these compressed spheres 4 which swell and subside under the pressure of the rider, releasing a progressive energy.

With the fourth and fifth functions, with the spheres 4 being at a distance from one another in their spaces or reservations 10 (as shown in FIG. 3), upon compression, the spheres 4 create two independent functions, wherein the stand of the foot laterally may therefore be corrected by squeezing one or the other of these two spheres 4.

Figure 5:
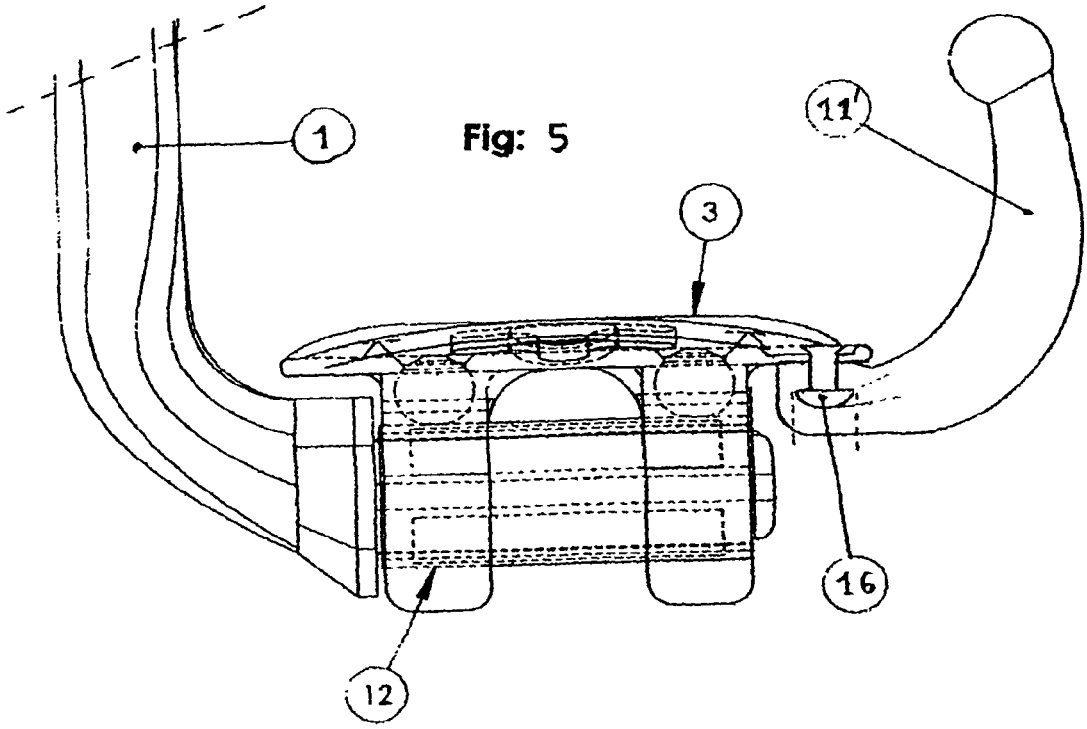
FIG. 5 represents a different type of assembly (or of positioning) of the foot abutment made of flexible material attached to the edge of the floor.

As shown in FIG. 1, the abutment 11, made of flexible material, serves to hold the stirrup assembly 20 together and retain the foot of the rider laterally in the stirrup. According to an aspect of the invention, as shown in FIG. 2, the abutment 11 is attached at the end of the square 7 via the fastening 14, and in embodiments, the abutment 11 may, if necessary, pivot on the fastening 14. As shown FIG. 5, with an alternative embodiment, an abutment 11' may be attached to a side of the floor 3 via fastening 16. Additionally with an alternative embodiment, as shown in FIG. 6, an abutment 11" may be adjusted and slide in its fastening 16, such that the stirrup assembly 20 can be adjusted to the width of the rider's foot.

Figure 6:
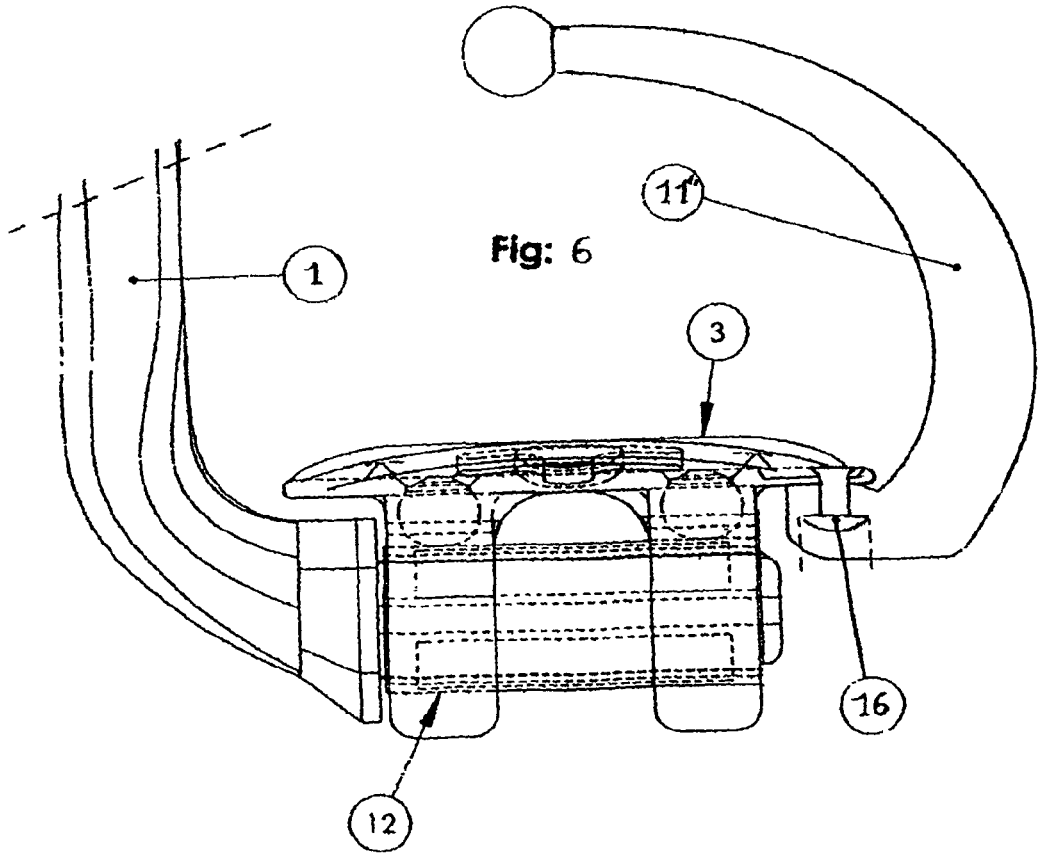
FIG. 6 represents a view of the foot abutment attached to the edge of the floor, in a different shape, with return on the shoe.

Moreover, as shown in the exemplary embodiment of FIG. 6, the abutment 11" may also have a shape returning on the shoe of the rider in order to hold the foot of the rider on the floor 3, and therefore make it a contact stirrup in its height while retaining maximum security.

Figure 7:
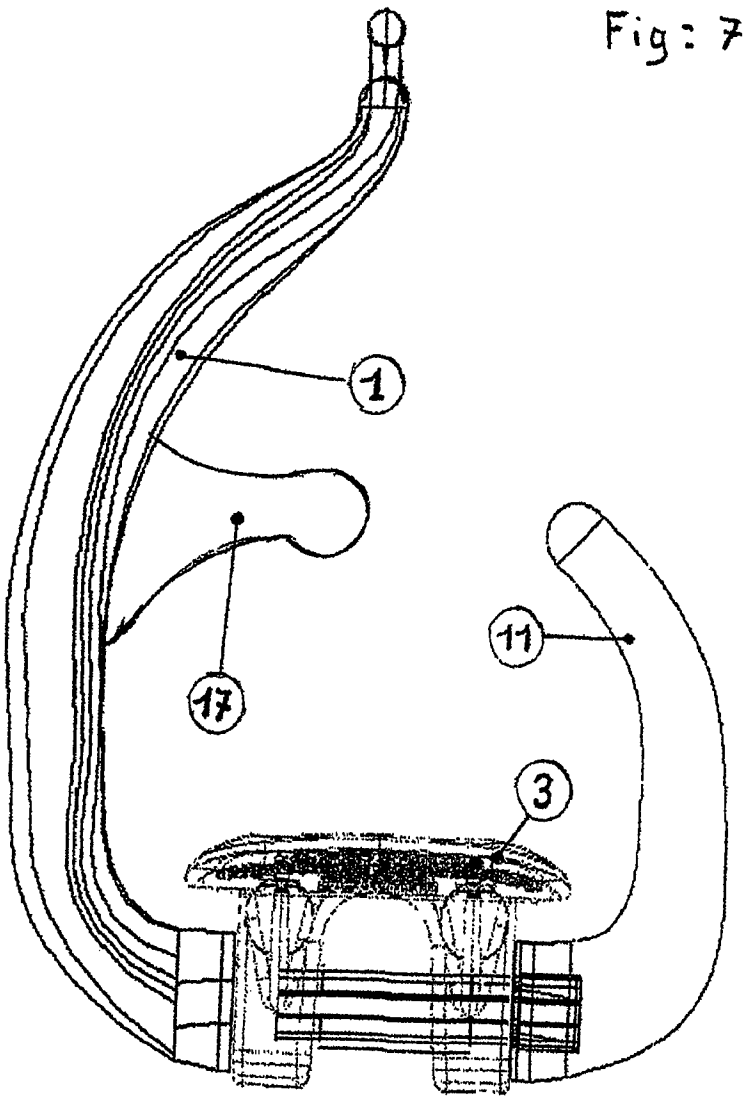
FIG. 7 represents a view of the abutment with an additional foot abutment attached to the branch.
Figure 8:
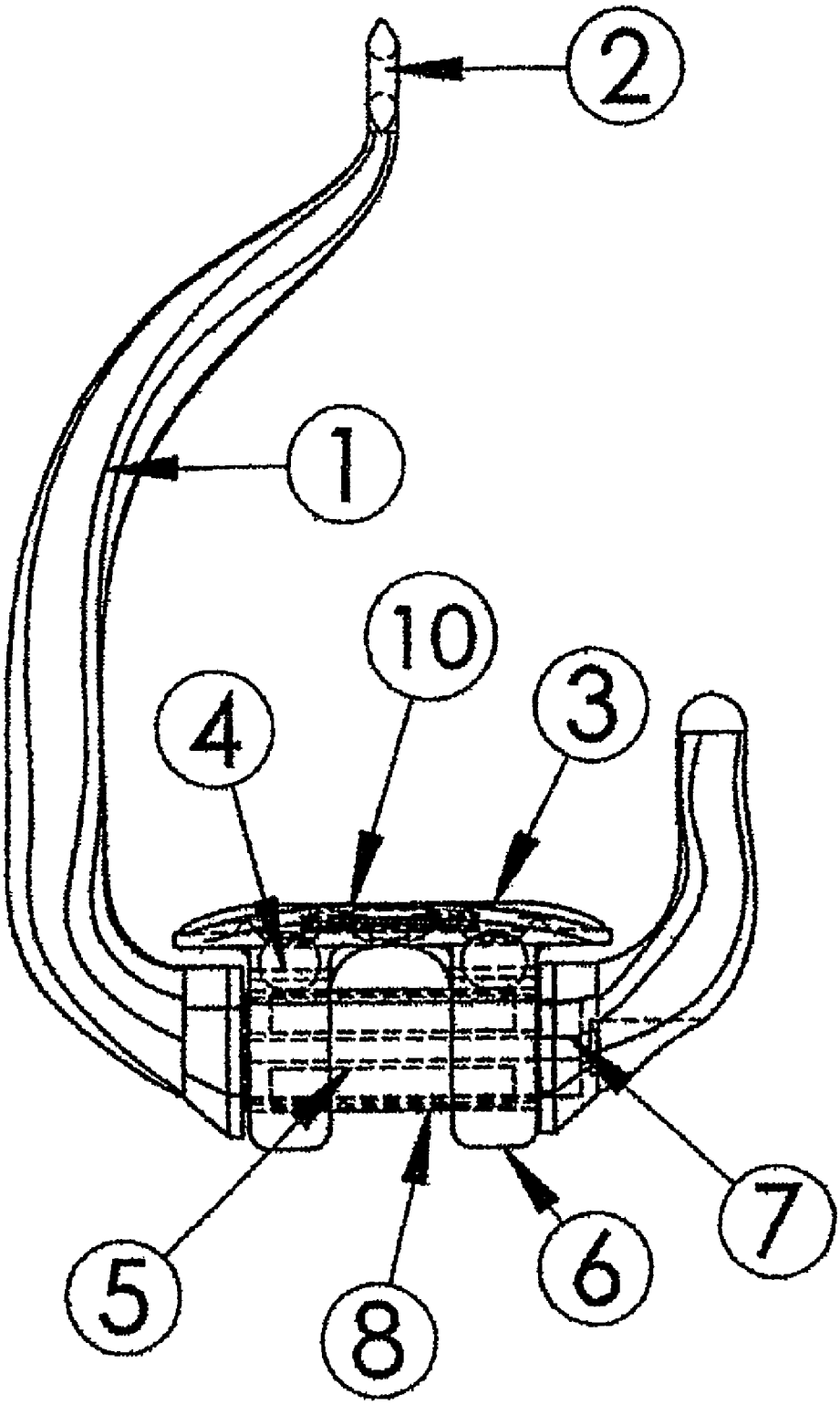
FIG. 8 represents an assembled view of the stirrup assembly.

According to an additional aspect of the invention, as shown in FIG. 7, the supporting structure 1 may include a foot abutment 17 made of flexible material. The foot abutment 17 is attached to the supporting structure 1 at a certain height, in order to keep the foot of the rider on the floor 3.

As shown in FIG. 4, the floor 3 has a shape curved upward on its front and rear portion at an angle of approximately 165 degrees, such that the floor 3 closely hugs the shape of the rider's sole. Moreover, the surface, length and shape of the floor 3 is sufficient to give a maximum stability to the foot of the rider. Additionally, the floor 3 includes a non-slip element 9 created directly in the material of the floor 3 or fitted to the floor 3.

Figure 9:
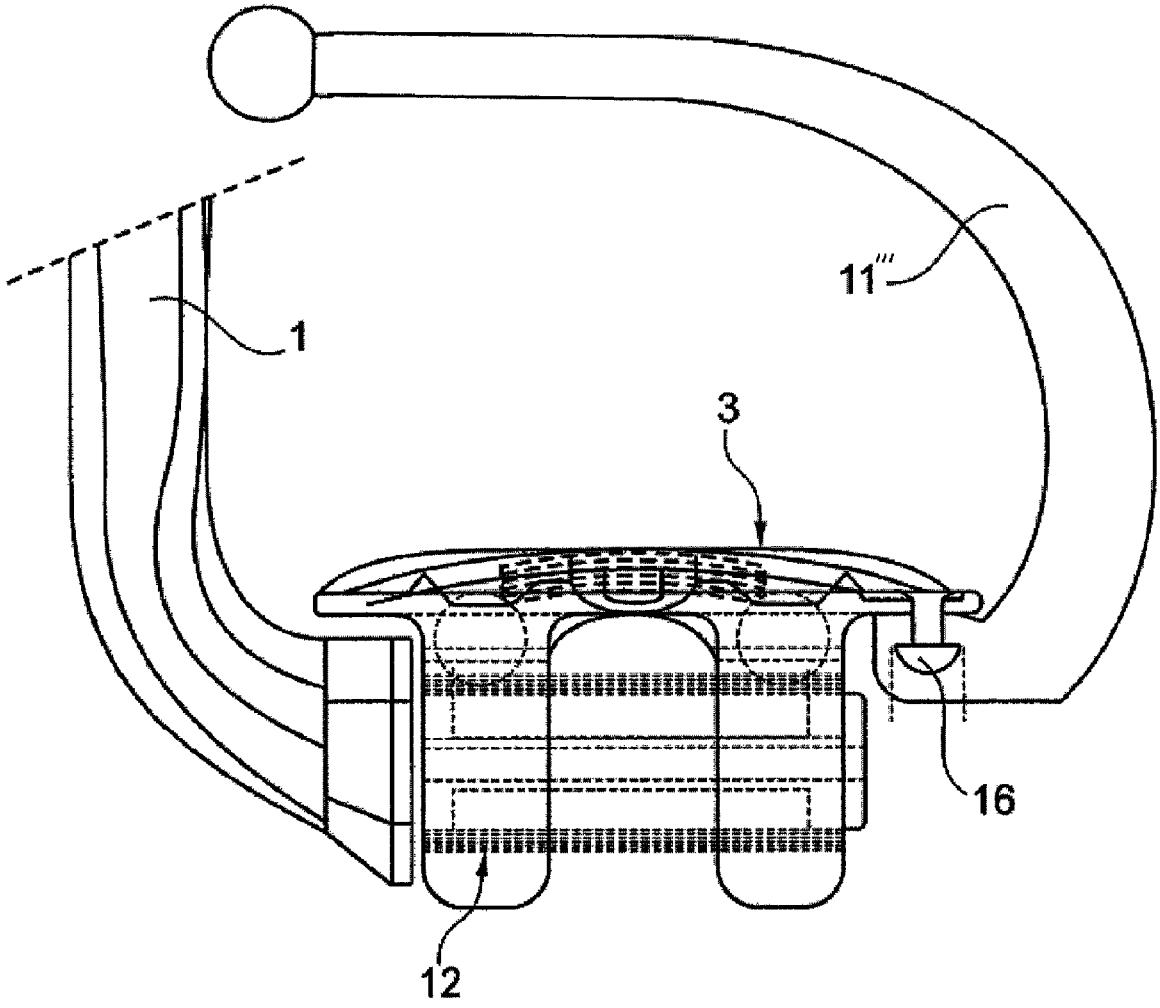
FIG. 9 represents an exemplary embodiment of the stirrup assembly having a closed stirrup shape.

Additionally, it should be understood that the present invention may well be used on a conventional closed stirrup shape. For example, FIG. 9 illustrates an exemplary embodiment of the stirrup assembly having a closed stirrup shape, wherein the abutment 11'" forms the closed stirrup.

In equestrianism, the stirrup assembly 20 of the present invention may be used at several levels. The stirrup assembly 20 is suitable for the various equestrian disciplines through its design and its benefits. The stirrup assembly 20 is aimed mainly at riders spending long hours on their mounts, e.g., endurance, trekking, instructor, outdoor school and show jumping. The stirrup assembly 20 provides a maximum of comfort and safety to the rider.

Naturally the invention is not limited to the sole embodiment described, modifications remaining possible from the point of view of the make-up of the various elements, or by the substitution of a technical equivalent without, for all that, departing from the field of protection of the present cited invention.

The invention claimed is:

1. A riding stirrup comprising:

a supporting structure terminating in a solid shape;

a mechanical assembly pivotably mounted on the supporting structure and around the solid shape; and a floor assembly comprising at least one U-shaped profile, a floor, and one or more resilient structures, wherein the floor assembly is mounted on the mechanical assembly for vertical movement relative to an axis of the solid shape, wherein the one or more resilient structures comprise at least one of flexible and resilient material and at least one of a polyurethane and a rubber having at least one of a different density, hardness and color, and wherein the one or more resilient structures are housed between the floor and a metal tube in spaces and the downward and upward movements of the floor are realized upon compression or relaxation of the one or more resilient structures.

2. The riding stirrup of claim 1, further comprising an abutment mounted at an end of the solid shape, wherein the abutment retains the mechanical assembly and the floor assembly on the supporting structure.

3. The riding stirrup of claim 2, wherein the abutment is pivotably attached to the end of the solid shape.

4. The riding stirrup of claim 2, further comprising a fastening on an end of the solid shape, wherein the abutment is pivotably attachable to the end of the solid shape via the fastening, wherein the abutment comprises a flexible or semi-hard material, and the flexible or semi-hard material comprises at least one of a polyurethane material, a rubber material and a metal covered with a flexible material.

5. The riding stirrup of claim 1, wherein the floor is ergonomically adapted to a sole of a rider and comprises a non-slip element one of mounted or fitted on the floor.

6. The riding stirrup of claim 1, wherein the solid shape is one of a square, an octagon and a cruciform fixedly attached to the supporting structure, wherein the solid shape includes at least two opposite ridges oriented along an axis of the supporting structure, and wherein a fastening is arranged at an end of the solid shape via at least one of a threaded hole, a stainless steel washer, a screw, and a protruding portion.

7. The riding stirrup of claim 1, wherein the floor assembly compresses and relaxes the one or more resilient structures by pressure on the floor.

8. The riding stirrup of claim 1, wherein the mechanical assembly comprises a metal tube, having an inner dimension greater than an outer dimension of the solid shape, housed around the solid shape.

9. The riding stirrup of claim 8, wherein the at least one U-shaped profile is slidably positionable on the metal tube, and an internal height of the at least one U-shaped profile being an average dimension of approximately 10 mm greater than a height of the metal tube, in order to arrange a space therein.

10. The riding stirrup of claim 1, wherein the mechanical assembly is pivotably movable from an initial position forward and backward at an angle from 0 to 50 degrees relative to the supporting structure, and returnable to the initial position via the floor assembly.

11. The riding stirrup of claim 1, wherein the floor and the at least one U-shaped profile are at least one of connected and formed of a single part.

12. The riding stirrup of claim 1, wherein the floor and the at least one U-shaped profile are at least one of foundry cast and reconstituted as a single component.

13. The riding stirrup of claim 1, wherein the one or more resilient structures comprises two resilient structures placed at a distance from one another on each side of the floor, housed in spaces in the floor, and wherein the two resilient structures generate two independent functions on vertical pressure on each side of the floor.

14. The riding stirrup of claim 1, wherein the one or more resilient structures comprise at least one of metal springs, spheres or squares of resilient material, wherein the one or more resilient structures, through at least one of their density, hardness or stiffness, are adapted to different weights of riders, in successively determined weight brackets.

15. The riding stirrup of claim 14, wherein a different color of the resilient material corresponds to each of the weight brackets.

16. The riding stirrup of claim 1, wherein the riding stirrup is approximately three-quarters closed and includes an opening in a top portion of the riding stirrup in order to release a foot.

17. The riding stirrup of claim 1, further comprising:

a fastening; and an abutment slideably attached via the fastening to a lower, outer side of the floor and beneath the floor, wherein the abutment is slideably adjustable relative to the floor to reduce or increase a space reserved for a foot, and wherein the abutment rises above and at least partially over the foot, in order to at least one of make contact with the foot and retain the foot in the riding stirrup.

18. The riding stirrup of claim 1, wherein the floor comprises:

a length;

a width;

a surface area;

a front portion;

a rear portion; and an ergonomic upper face, wherein the front portion and rear portion are bent toward the ergonomic upper face at an angle of approximately 165 degrees, and the surface area is sufficiently large to actuate the mechanical assembly, wherein the surface area comprises at least one of a non-slip element formed from a multitude of holes whose circumferences are pushed upward and a fitted non-slip element formed on the surface area.

19. The riding stirrup of claim 1, further comprising a foot abutment vertically-adjustably attached to an inner side of the supporting structure to maintain a foot positioned on the floor, wherein the foot abutment comprises at least one of a flexible material, a semi-hard material, and a metal covered with a flexible material.

20. The riding stirrup of claim 1, further comprising a closed stirrup shape.

21. A riding stirrup comprising:

a supporting structure terminating in a solid shape;

a mechanical assembly pivotably mounted on the supporting structure and around the solid shape; and a floor assembly comprising at least one U-shaped profile, a floor, and one or more resilient structures, wherein the floor assembly is mounted on the mechanical assembly for vertical movement relative to an axis of the solid shape, wherein the mechanical assembly comprises a metal tube, having an inner dimension greater than an outer dimension of the solid shape, housed around the solid shape, and wherein the solid shape comprises a number of faces and the tube has a number of corners corresponding to the number of faces, and the mechanical assembly further comprises flexible material located between the number of faces of the solid shape and the corresponding number of corners of the tube, and the flexible material comprises at least one of a polyurethane material, a rubber material, a molded material and a cast material.

22. The riding stirrup of claim 21, wherein the flexible material comprises four single sections of flexible material.

* * * * *